US007262690B2

(12) United States Patent
Heaton et al.

(10) Patent No.: US 7,262,690 B2
(45) Date of Patent: Aug. 28, 2007

(54) METHOD AND SYSTEM FOR MONITORING EVENTS

(75) Inventors: Michael Heaton, Wingrave (GB); Jonathan Beardmore, Wingrave (GB); Andrew Eccleston, Wingrave (GB)

(73) Assignee: Mygard PLC, Buckinghamshire (GB)

( * ) Notice: Subject to any disclaimer, the term of this patent is extended or adjusted under 35 U.S.C. 154(b) by 385 days.

(21) Appl. No.: 10/470,542

(22) PCT Filed: Jan. 30, 2002

(86) PCT No.: PCT/GB02/00417

§ 371 (c)(1),
(2), (4) Date: May 13, 2004

(87) PCT Pub. No.: WO02/061706

PCT Pub. Date: Aug. 8, 2002

(65) Prior Publication Data

US 2004/0189460 A1 Sep. 30, 2004

(30) Foreign Application Priority Data

Jan. 30, 2001 (GB) ..... 0102355.5

(51) Int. Cl.
*G08B 23/00* (2006.01)

(52) U.S. Cl. ..... 340/500; 340/531; 340/506; 340/539.25

(58) Field of Classification Search ..... 340/500, 340/531, 506, 514, 539.1, 539.25, 573.1, 340/5.8; 348/148
See application file for complete search history.

(56) References Cited

U.S. PATENT DOCUMENTS 4,141,006 A 2/1979 Braxton (Continued)

FOREIGN PATENT DOCUMENTS

EP 0295146 A 12/1988

(Continued)

*Primary Examiner*—Anh V. La
(74) *Attorney, Agent, or Firm*—Fay Sharpe LLP

(57) ABSTRACT

The invention provides a monitoring and control system comprising a control unit (50) for receiving signals from a variety of detection devices (10, 21, 502) monitoring events pertaining to security. The control unit (50) transmits information related to the reception of such signals to a remote monitoring station (100) that stores and operates automatic evaluation routines to send an alert call to a chosen remote user terminal. The remote user terminal may conveniently be a PC, a PDA, a mobile phone or WAP enabled mobile phone, or a fixed line telephone. In some embodiments of the invention it may be possible to provide the monitoring station (100) with transmitted information including verification of the event. The nature of the event and verification may be determined by the control unit (50) or by the monitoring station (100). The invention also provides a control unit (50) for receiving alarm signals generated by detection devices (10, 21, 502) in response to detectable events, the control unit comprising interface unit (51) for receiving generated signals and a unit for transmitting information relating to the generated signals (500, 501, 510, 519) to a remote monitoring station (100).

35 Claims, 6 Drawing Sheets

System Overview

U.S. PATENT DOCUMENTS

| | | | | |
|---|---|---|---|---|
| 4,257,038 | A | 3/1981 | Rounds et al. | |
| 4,520,503 | A | 5/1985 | Kirst et al. | |
| 4,581,606 | A | 4/1986 | Mallory | |
| 5,023,901 | A * | 6/1991 | Sloan et al. | 379/38 |
| 5,319,698 | A | 6/1994 | Glidewell et al. | |
| 5,334,974 | A | 8/1994 | Simms et al. | |
| 5,446,445 | A | 8/1995 | Bloomfield et al. | |
| 5,499,196 | A * | 3/1996 | Pacheco | 702/81 |
| 5,651,070 | A | 7/1997 | Blunt | |
| 6,040,770 | A * | 3/2000 | Britton | 340/539.24 |
| 6,246,320 | B1 * | 6/2001 | Monroe | 340/506 |
| 6,975,220 | B1 * | 12/2005 | Foodman et al. | 340/531 |

FOREIGN PATENT DOCUMENTS

| | | | |
|---|---|---|---|
| EP | 0 308 046 | | 3/1989 |
| EP | 0591585 | A | 4/1994 |
| FR | 2661023 | A | 10/1991 |
| FR | 2793334 | A | 11/2000 |
| GB | 2 273 593 | | 6/1994 |
| GB | 2 324 630 | | 10/1998 |
| GB | 2335523 | A | 9/1999 |
| GB | 2 349 293 | | 10/2000 |
| GB | 2 370 400 | | 6/2002 |
| WO | WO96/36301 | | 11/1996 |

* cited by examiner

Automatic Monitoring Station Embodiment – Logical Units

System Overview

METHOD AND SYSTEM FOR MONITORING EVENTS

TECHNICAL FIELD

The present invention relates to a method and a system for monitoring events and devices and apparatus adapted and configured for use in such a system. More particularly the invention relates to automatically monitoring, detecting and reporting events. Even more particularly the invention relates to automatically monitoring, detecting and reporting breaches of security.

SUMMARY OF THE INVENTION

The invention provides a monitoring and control system comprising: a control unit for receiving signals from a variety of detection devices monitoring events pertaining to security, the control unit having means for transferring information related to the reception of such signals to a remote monitoring station and having control means for actively controlling one or more detection devices; the monitoring station having programmable storage means storing automatic evaluation routines to initiate the automatic transfer of information to a chosen remote user terminal;

wherein the monitoring station is responsive to commands initiated by a remote user terminal, which is remote of the monitoring station and the site being monitored, this may be the chosen remote user terminal or an alternative remote user terminal, to establish a link between the remote user terminal and the control unit to cause the control means thereof to initiate a change in the operative state of at least one of the detection devices.

The invention further provides a method of monitoring a site equipped with one or more detection devices for monitoring events pertaining to security and generating signals in response to detectable events, the method comprising:

utilising a local control unit for receiving signals related to events pertaining to security, the local control unit having means for transferring information related to the reception of such signals to a remote monitoring station and having control means for actively controlling the one or more detection devices;

utilising a monitoring station, remote from the local control unit, to initiate the automatic transfer of information to a chosen remote terminal in accordance with automatic evaluation routines programmed onto the monitoring station; and enabling the monitoring station to respond to commands initiated from a remote user terminal, which is remote of the monitoring station and the site being monitored and which may be the chosen remote user terminal or an alternative remote user terminal, to establish a link between the remote user terminal and the control unit to cause the control means thereof to initiate a change in the operative state of at least one of the detection devices.

The invention also provides an automatic monitoring station for receiving first information related to events detectable by detection devices, the monitoring station comprising means adapted to receive such first information and programmable storage means storing:

i) routines for evaluating received first information, ii) a record of actions to be taken in response to a variety of types of evaluated first information, iii) routines for matching evaluated first information to a particular stored action or set of actions, and iiii) routines for initiating the matched action or set of actions; wherein some actions include transferring second information relating to detected events to a chosen remote terminal.

The invention also provides a control unit for receiving alarm signals generated by detection devices in response to detectable events, the control unit comprising interface means for receiving generated signals and means for transmitting information relating to the generated signals to a remote monitoring station.

Such a control unit can be suitably utilised as a local control unit or control unit in accordance the method or system of the invention, but may also be provided as a stand alone unit to receive signals and transmit information relating to received signals pertaining to security to transmitted to any remote monitoring station. A particularly useful application of a control unit enables a site with a previously installed non-monitored security system to be monitored. The control unit enables the transfer of information relating to detectable events from the installed security system to a monitoring station by receiving and processing alarm signals generated by detectors in the existing installed system.

In some embodiments of the invention the system comprises a plurality of detectors making up a detector array or network, one or more interface units and a local control unit (Alarm Control Unit, or ACU). These elements are located at the site that is to be monitored, and may be connected by wires or may be in wireless communication. Generally the interface units may be considered part of the local control unit, even if they are physically discrete. The system further comprises a remote monitoring station (which may be an Automatic Monitoring Station, or AMS). An AMS may be capable of communicating with a large number of ACUs, for instance via fixed or mobile telephony.

The AMS can respond to events according to preset commands or routines, which are recorded in a database. The response can include verifying the event and where necessary initiating a transfer of information relating to an event to a chosen remote user terminal. The remote user terminal may conveniently be a PC, a PDA, a mobile phone or WAP enabled mobile phone, or a fixed line telephone. In some embodiments of the invention it may be possible to provide the AMS with transmitted information including verification of the event. The nature of the event and verification may be determined by the ACU or by the detection device intended to respond to that event, although generally it will be desirable to allow the AMS to deal with raw information.

An ACU may provide a common interface for alarm signals generated in response to events detected by the detectors. For instance, the ACU may detect any alarm signal outputs from the detectors and transmit an alert, that is, information relating to such signals, to the AMS. Alternatively the ACU may monitor and log alerts/information relating to such signals, transmitting the information when interrogated by the AMS.

At least some detectors may issue signals of the same general character, for instance they may issue audible alarm signals in response to an event. They may additionally or alternatively issue visible alarm signals, IR alarm signals, RF alarm signals. In one embodiment of the invention the ACU is equipped with means for distinguishing between different signals of the same general character.

In preferred embodiments of the invention the AMS has the ability to instruct the ACU to arm or disarm itself. This has numerous applications, for example:

The alarm can be deactivated just for the duration of a tradesperson's (or similar) visit, then reactivated, thus avoiding the need to give the tradesperson the PIN code or disabling the alarm for the entire user absence.

The alarm can be activated if the user has forgotten to activate it before going out, or activated remotely after children or staff or others who may not be entrusted with setting the alarm have left the monitored site.

The alarm can be deactivated if the user has armed the system in error—for example when a visitor is expected who has means of entry but who does not know how to disarm the alarm.

In other preferred embodiments of the system, the AMS can be utilised to perform zonal monitoring of a site. In zonal monitoring a number of detection devices are used to monitor a site for detectable events. Patterns of signals generated by detectors may be recorded and analysed to determine or verify the nature of an event or security breach. The AMS may be programmed to require a sequence of events to be detected, such as IR detection in different parts of the monitored site within a predetermined time limit, to be detected or require two types of events, such as breaking of electrical contact at one detector and change in ambient temperature at a second detector, to be detected before carrying out a particular action. In other cases the AMS may inhibit transfer of information to a remote terminal or otherwise modify an automatic evaluation routine unless it receives information relating to a second event in addition to information relating to a first event. Such a function is useful to prevent an AMS issuing false alarm calls to a chosen remote user terminal where, for example, a detection device is faulty and repeatedly generates signals then received by an ACU, or, for example, the remote terminal is located at a police station or private security firm whose officers or staff will only attend the site where an security breach can be confirmed. As used in this specification, the term "zonal" does not imply that events must be detected in different parts of a monitored sites, merely that signals from more than one detector can be separately identified.

The method, system, devices and apparatus of the invention may be used to provide a site monitoring service to end users. An end user is able to tailor the service provided by configuring the AMS and/or the ACU. The end user may access the AMS via a remote terminal. Typically, but not exclusively, the remote terminal will be an internet enabled PC, mobile telephone or television. The user will be presented with an user interface allowing him or her to amend, for instance, what events are monitored, when they are monitored, or to where alerts are sent. The user may also be able to reconfigure other elements of the monitoring system, such as detection devices, where this is provided for. In addition the user may be able use the user interface to request supplementary information relevant to an alert, such as live video or audio feeds from further detection devices, to verify the nature or circumstances of the event causing the alert.

The method, system, devices and apparatus of the invention may be used to monitor sites for any event where detection and alarming may be required, particularly hazardous events and examples include fire, flood, intruder alert, alerts for poisonous or hazardous gases or chemicals, and alerts for other events also pertaining to the security of a monitored site. Generally one or more of the following types of detection devices will be utilised:

PIR intruder detector.

Carbon monoxide detector.

Gas detector (natural gas).

Circuit breaking detector

Power failure detector (activates if power is interrupted for more than a predetermined length of time).

Flood detector (activates if water is detected between two electrodes).

Temperature detector (activates if temperature moves outside precept limits).

Sound detectors—two types are possible:

the first activates if prolonged sound above a certain level is detected (e.g., the bell of a proprietary, fitted, alarm system), and the second activates if certain sudden sound wave patterns are detected (e.g. breaking glass).

Light detector.

Voice activated detector for number dialling and voice transmission

High-resolution real time video utilising compression/decompression software suitable for Internet streaming.

U.S. Pat. No. 5,319,698 discloses a security system comprising sensor units, a receiver for receiving signals from the sensor units, a transmitter activated by the receiver, which transmits a signal to a local security station and activates an alarm and a sequence of telephone calls. This system has the disadvantage that the user cannot alter the operational status of the system remote from the monitored area.

BRIEF DESCRIPTION OF THE FIGURES

Other aspects and features of the invention will be apparent from the following description in which embodiments of the invention will be described, by way of example only, with reference to the figures of the accompanying drawings. In the drawings.

DETAILED DESCRIPTION OF PREFERRED EMBODIMENTS OF THE INVENTION

Figure 1:
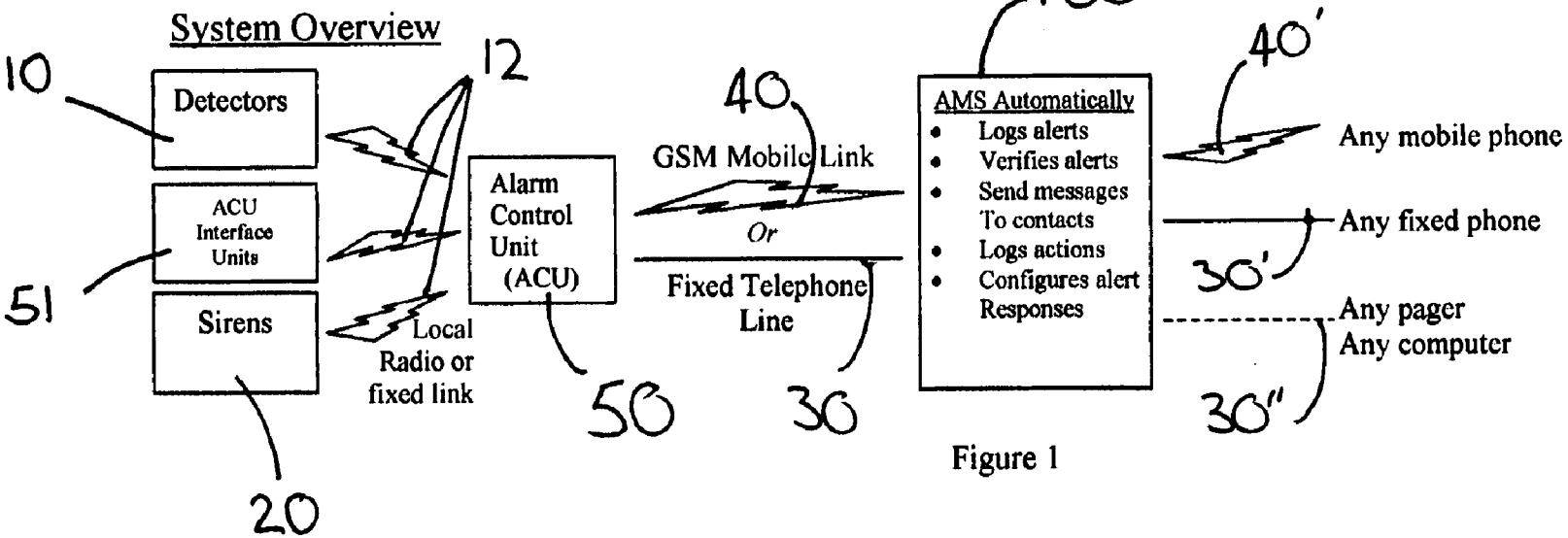
FIG. 1 illustrates schematically the elements of a system constructed in accordance with the invention.

To aid interpretation of the description of examples of the system and apparatus of the invention, and methods of monitoring sites, using the system and apparatus, of the invention a glossary of some terms used is provided:

| | |
|---|---|
| ACU | An Alarm Control Unit. This is a local control unit provided at a monitored site. The ACU is adapted to receive signals generated in response to events by detection devices also located at the monitored site, process the signals and transmit information relating to the received signals to a remote monitoring station |
| AMS | An Automatic Monitoring Station. This has programmable storage means allowing it to identify events pertaining to security detected by detection devices and carry out actions determined by the nature of the identified event. Some of the actions will include automatically sending information pertaining to security to a chosen remote terminal. In some embodiments of the invention, a user of a monitoring system utilising the AMS may alter the actions or sequence of actions to be taken by instructing it from a remote terminal. |
| Alert | A signal from the ACU to the AMS indicating that a detector has been activated. The message may include the detector identity, type and information describing the nature of the alert. |
| Alert Actions | The actions that the system user has instructed the system to undertake in response to a particular type of Alert. |
| Alert Recipient | A person or device chosen to receive a message from the AMS following an Alert. |
| Arm | The ACU is armed by various means, including entering a code via a keypad of using a radio-signalling device or a key, or receiving a message from the AMS to arm. When the ACU becomes Armed the ACU may wait for a pre-determined period (typically less than one minute) after which any Detectors signalling to the ACU that they have detected an event are assumed to be valid. The ACU may inform the AMS that it has been armed. |
| Cancellation Message | A message sent from the ACU to the AMS informing the AMS that a valid Cancellation Sequence has been received in respect of a particular Provisional Alert. |
| Cancellation Sequence | A mechanism (such as the entry of a PIN Code into a device connected by wires or wireless to the ACU) by which the customer can inform the ACU that the recent Detectable Event is not to generate an Alert. The Cancellation Sequence must be correctly carried out within a short period of the Detectable Event. If it is not an Alert will normally be generated. |
| Detectable Event | Anything that causes a detector to be activated and that would, in the absence of a correct Cancellation Sequence, cause an Alert to be generated. |
| Disarm | The ACU is disarmed by various means similar to those used to arm it. When the ACU becomes disarmed is sends a message to any Detectors capable of acting upon the message and so configured that they ACU is disarmed and that the Detector may also disarm itself. Some detectors (for example those monitoring smoke, dangerous gasses and activation of a panic or personal attack button) are never disarmed and the ACU always remains Armed in respect of such detectors. The ACU may inform the AMS that it has been disarmed. |
| PIN Code | A secret customer-specified sequence of number (or letters or other type of code) used to arm and disarm the ACU. |
| Provisional Alert | A message sent from the ACU to the AMS informing the AMS that a detectable event has occurred and for which there remains an opportunity for a valid Cancellation Sequence to be generated. |

Figure 2:
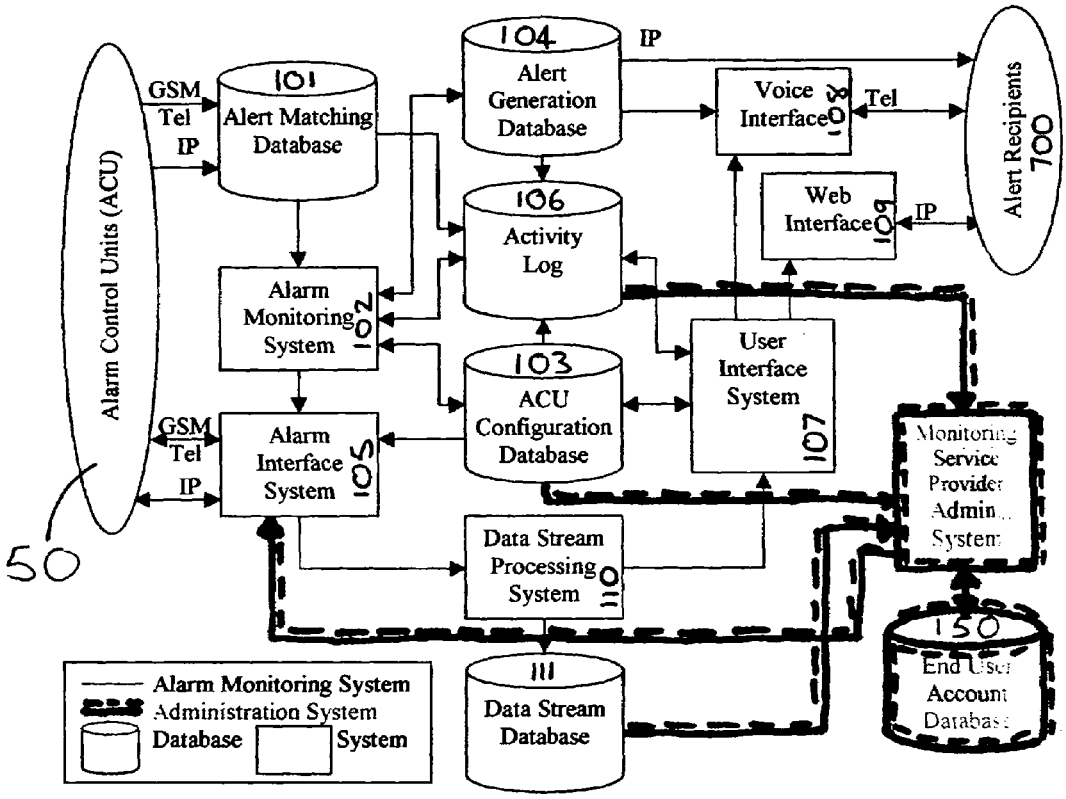
FIG. 2 illustrates schematically the logical units of an automatic monitoring station constructed in accordance with the invention.

With reference particular reference to FIG. 2, an AMS (100) may contain the following logical elements:

Alert Matching Database (AMD) (101)

The AMD (101) consists of a database, a telephony interface and an IP interface to receive Alerts from any ACU (50). The AMD receives messages from the ACU and may also detect Calling Line Identification (CLI), which may be used to authenticate the message.

When the AMD receives an Alert from an ACU, which may happen every time an armed ACU is activated, the Alert is stored in the database together with the time of receipt. When a Disarm message is received the AMD will identify any corresponding Alert which may be in the database and the Alert/Disarm sequence will be logged in the Activity Log and no further action will be taken. Any Alerts which are not followed within a given period by a Disarm message will be treated as Alarms and are sent to the Alarm Monitoring System (AMSys) (102) for processing. In the case of a Panic Alert this creates an immediate alert without the buffering and disarm time lapse described above.

The following truth table describes the action of the system when matching Alert and Disarm codes are received with the same ACU identifier, but different CLI is received to that expected.

| | Order of Verification → | | |
|---|---|---|---|
| | CLI Does Not Match ACU Verification Table | CLI Missing | CLI of Disarm Does Not Match CLI of Alert |
| Alert Message | Generate 'Have you changed your phone number' letter. Otherwise normal operation. | Normal operation. | N/A |
| Disarm Message | Normal operation. | Instruct AMS to request PIN Authentication. If this fails reject Disarm Message. | Reject Disarm message. Generate additional Action Log entry 'Disarm Tamper Detected' |

In other embodiments CLI is not used, but the identity of the ACU is transmitted as part of the message from the ACU to the AMS Logically, the AMD may consists of two principal tables:

1. Active Alerts Table. Stores Alerts, Alarm Unique Identifier and Associated Calling Line Identification which are less than a given period old and against which Disarm messages have not been received.
2. ACU Verification Table. Matches Alarm Unique Identifier with Calling Line Identification.

Alarm Monitoring System (AMSys) (102)

This is the intelligence embedded within AMS (100). When an Alert is passed on from the AMD (101) the AMSys (102) consults the ACU Configuration Database (103) to decide what action to take. AMSys (102) has priority access to the ACU Configuration Database (103). Having determined the appropriate action to take the AMSys makes an entry into the Activity Log (106) and instructs other systems to carry out actions. Possible actions include:

Request PIN Authentication. The Alarm Interface System (AIS) (105) phones the monitored site to request a PIN entry via a telephone handset. The recipient is given, say, three attempts or 1 minute to enter the correct PIN. If no correct PIN is entered then the Alert is treated as genuine, subject to alarm verification and the ACU (50) is instructed to sound local sirens (20) if applicable.

Determine the nature of the alert.

Send messages (voice, IP, SMS or Pager) to specified Alert Recipients.

Make entry in Alert Action Log.

Record and analyse Zoned Activation for alert verification system.

Instruct Data Stream Processing System (110) to open a channel to the ACU (50) for download of sound or video, or instruct Data Stream Processing System (110) to manage transfer of sound or video from ACU for storage and possible onward transmission.

Send an e-mail message

ACU Con figuration Database (ACUCD) (103)

The ACUCD (103) may contain:

System Configuration Table (SCT). A description of the current configuration of the Alarm System (identical to that stored locally in the SCT) and current alarm status, including any zones activated.

Alert Action Table. List of actions to be taken when a particular Alert is detected.

Alert Generation Database (AGD) (104)

This database oversees the transmission of messages to Alert Recipients (700) if no disarm has taken place. The AMS (100) may, in response to an Alert, identify that various Alert Recipients (700) need to be informed and the address where the alert has been activated. These recipients and the associated location and alert identifying message is passed to the AGD (104) that manages the transmission of those messages (i.e. queues, repeat attempts and so on). The AGD (104) interfaces to the Voice Interface (108) for messages using voice synthesis. For IP based messages the AGD has a direct Internet connection (30").

All Alerts, Message attempts and their result are recorded in the Activity Log (106). For example, there may be entries made containing information similar to the below, presented in a manner similar to the below:

| Date and Time | Message | Alert Recipient | Result |
|---|---|---|---|
| 15/11/00 12:19 AM | Intruder Alarm Alert Received by MyGard | N/A | N/A |
| 15/11/00 12:20 AM | Intruder Alarm Alert phone call to Mr J. Bloggs | (07790 926039) | No Answer |
| 15/11/00 12:20 AM | Intruder Alarm Alert pager message to Mr F. Brown | (0207 926 0394) | Sent |
| 15/11/00 12:25 AM | Retry: Intruder Alarm alert call to Mr J. Bloggs | (07790 926039) | Answered |
| 15/11/00 12.25 AM | Intruder Alarm activated at (address) Abel Security | e-mail address | Acknowledged |

The AGD will also manage communications with Police Control Rooms, private security response units and the Fire Brigade. The AGD will generally deal with jobs in First In, First Out (FIFO) order, except for Panic Alerts that receive immediate attention. Keyholders who, if police/private security are attending, will be contacted early in the alert cycle and asked to confirm their attendance automatically by pressing the * button on their phone—this action is then registered on the Action Log Alarm Interface System (AIS) (105)

The AIS (105) is used for general two-way communication with the user's ACU (50) but not Alert messages and Disarm messages, which are sent to Alert Matching Database (101). It is intelligent in that it can undertake complex tasks, such as uploading a revised SCT and updating the ACUCD (103) or managing a video stream from an ACU. Generally, the AIS (105) is separated from the AMD (101)

because the former deals with time critical activities only (receiving Alerts and Disarms) whilst the AIS deals with a more complex range of interactions.

Generally, the AIS (105) is fault tolerant and is able to prioritise its resource utilisation based on the importance of the activity. The AIS will keep track of its resource utilisation and could use a negative acknowledgement such as 'Try Later' or similar to non-time critical requests from ACU's if resources are scarce.

AIS can undertake housekeeping tasks, such as changes to system configuration or resetting after an Alert, send remote instructions to the ACU, such as remote arm and disarm, and activate data stream devices and receive inbound signals, for instance sound and video, and pass these to the data stream processing system for analysis.

Activity Log (106)

This records all events that are of relevance to a user. The Activity Log (106) conveniently serves at least these functions:

It provides feedback to the user as to the status of the ACU (50) and the source of any alarms that may have been activated, and the Alert Recipients (700) contracted.

It allows the user to use the monitoring system as a personnel-monitoring tool (e.g. to check whether contract security patrols have taken place or personnel have arrived at work on time). A simple filtering tool may usefully be provided to allow the user to focus on useful messages only.

User Interface System (UIS) (107)

This system links the web interface (109) and/or the voice interface (108), described hereinbelow, to those databases which supply information available to the user. The UIS (107) manages firewalls and password protection to prevent unauthorised access to Alarm Configurations.

Users are able to change Alarm Configurations via the web; these changes are delayed for a period of time so that a message can be sent to the previous Primary Contact to inform the user that a change to the Alarm Configuration is about to be enacted. Thus if an intruder attempts to disable an alarm by gaining unauthorised access to the web site, they will be detected by the user. However, initial configuration need not be delayed.

Another security feature of monitoring system is that user identification details, for instance PIN, name, address, primary (e.g. home) telephone numbers, are held in the User Account Database (150), which cannot be queried by the UIS (107). Thus any unauthorised user who evades the password security and manages to access and Alarm configuration will not easily be able to identify the protected monitored site.

Voice Interface (108)

This is based on a voice recognition system that may be configured to perform two tasks:

It delivers synthesised voice messages for outbound alert messages to alert recipients (700).

It permits inbound callers to check their alarm status by synthesised voice response. The system will, after entry of correct identification, relay the current alarm system status and then read out the contents of the Activity Log (106). This would generally be reported as the most recent alarms first, followed by actions taken.

Web Interface (109)

This interface (109) can be developed so that it is suitable for accessing from a variety of remote user terminals. For example it may be accessed via terminals enabled for using the WWW, WAP or interactive digital television (iDTV).

The User Web Interface (109) usefully permits users to carry out two basic tasks:

Check current alarm status and send remote arm/disarm messages.

Set or change the response to particular Alerts.

In some embodiments it may also permit users to set or change the configuration of the Alarm Unit.

Remote Arm/Disarm enables a user to arm and disarm the ACU (50) via the Web. This allows a user to allow entry to the monitored site (e.g. by tradespeople) without having to leave the monitored site unprotected all-day or giving the PIN to tradespeople. It may also allow remotely controlling, for instance via a mobile phone or other connectable device, other door locking and unlocking.

Remote Disarm messages are always copied to the Primary Contact to detect unauthorised disarm attempts. Users can elect to allow or disallow Remote Disarm. Users can subsequently change their election, requesting such a change via the web or other means. Activation of Remote Disarm is delayed for a period of time and the Primary Contact is notified of the request by post and voice or messaging.

User Account Database (150)

This maintains information about the user (name, address, and primary contact number) which is physically inaccessible to the UIS (107).

Automatic Data Stream Processing System (DSPS) (110)

Streamed data (sound and compressed video) from an ACU (50) can be directed to the DSPS (110) by the AIS (105). The DSPS (110) may have a range of analysis tools to analyse the signal:

Immediately after an alert activation it could compare a variable sound feed to a sample ambient noise level to determine intruder activity.

Immediately after an alert activation it could compare the data bits and edges and surfaces of two or more video images to detect sudden changes in the image (other than light intensity).

Immediately after an alert it could pass sound or video to an IP address for remote monitoring.

Alternatively, the ACU (50) may have verification software embedded within its functionality which can perform the tasks described above, obviating the need for a separate DSPS (110). In such embodiments the ACU may also be configured to perform zonal monitoring as described hereinbelow. The ACU would then send a verified alert signal to the AMS to instigate a pre-set response by the relevant AMS database.

Data Stream Database (111)

This stores reference images and ambient noise levels for comparison purposes, and also stores inbound images for future retrieval, for instance a still picture triggered by a movement detector activation.

Figure 3:
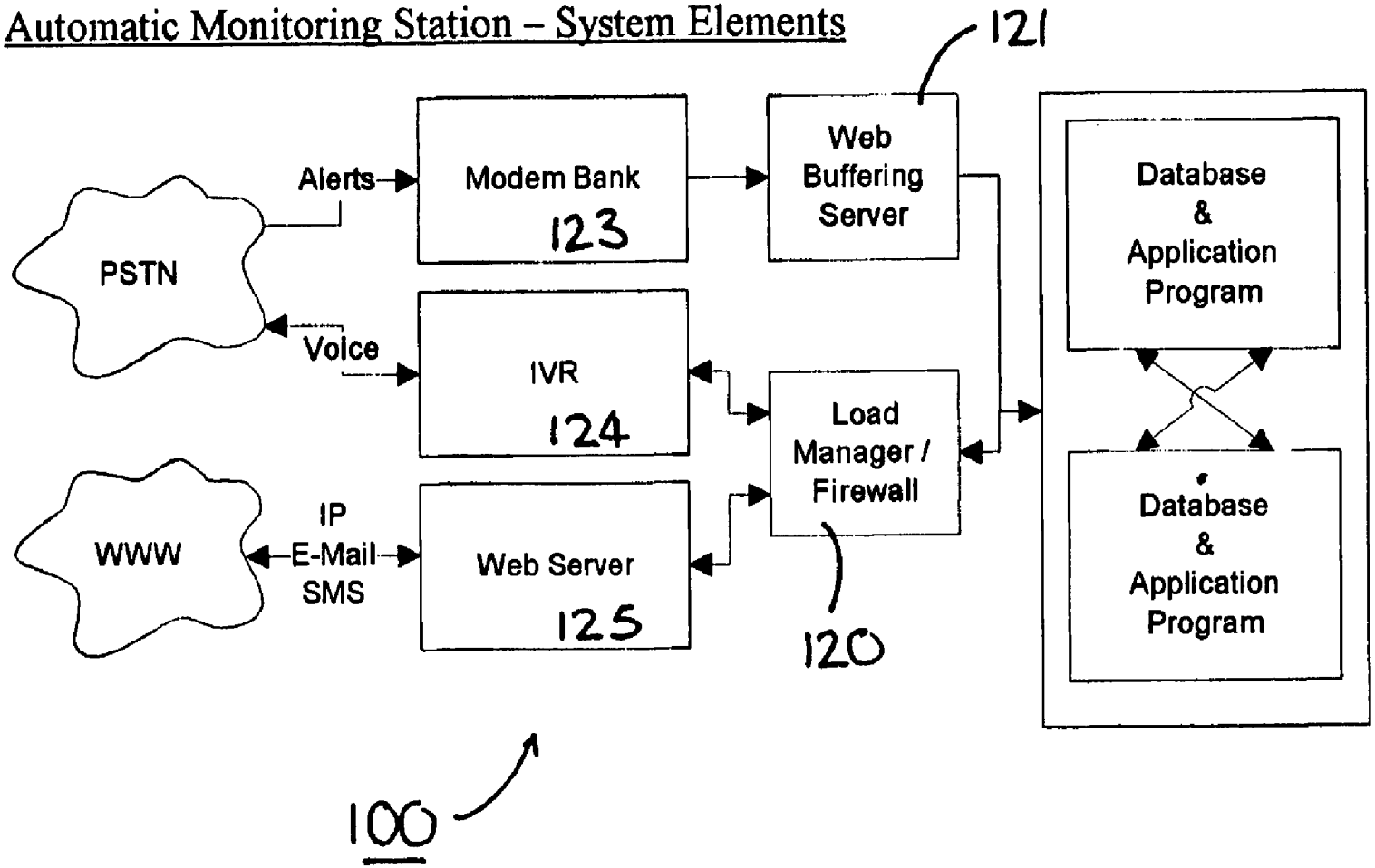
FIG. 3 illustrates schematically the elements of the automatic monitoring station constructed in accordance with the invention.

These logical units will generally be located together in one physical part of the AMS (100). FIG. 3 illustrates how the AMS can have access to the databases and application programs controlled by a firewall (120) and web buffering server (121). The firewall and web buffering server are located between the hardware storing the databases and application programs and the means for connecting to the ACU and users and Alert recipients. Connection may be made through a public switching telephone network (PSTN) (30, 30', 30") or GSM network (40, 40'). A modem bank (123), Interactive Voice Response System (IVR) (124) or web server (125) allow such connection to be made.

Web buffering is a further security mechanism present in some embodiments for preventing intruders from disabling the ACU before an alert message has been sent.

Where Web Buffering is enabled the ACU will send a Provisional Alert to the AMS immediately whenever a detectable event occurs, without waiting for Cancellation Sequence. If a Cancellation Sequence is subsequently received by the ACU then a Cancellation Message is sent to the AMS. If the AMS receives no Cancellation Message within a specified time then the AMS will commence execution of the relevant pre-set Alert Actions.

Using this further security method, a Provisional Alert will be generated very quickly following a Detectable Event, thereby greatly reducing the opportunity for an intruder to disable the ACU by, for example, destroying it. Furthermore, the availability of such a mechanism increases the risk associated with attacking any ACU, as the intruder will not know whether Web Buffering has been enabled and therefore cannot predict whether an attempt to disable the ACU will be successful.

The UIS can enable a user to reconfigure the parts of the system located at the monitored site by relaying instructions to the ACU, and in some cases the detection devices, through the AMS.

Remote Configuration of the ACU

The User AMS Interface can be used to allow the user to change the configuration of the ACU (for example, changing the sensitivity of a detector, or the time permitted to enter a Cancellation Sequence.) This permits a more flexible and comprehensive user interface to be developed for the ACU than normally the case with alternative home or business monitoring and/or security products.

Remote Maintenance and Upgrade of the ACU

The ACU may be reprogrammed remotely by the AMS, by means of messages sent by the AMS to the ACU, which is stored in non-volatile memory. The AMS uses this memory to carry out appropriate actions when the software originally supplied with the system suggests no appropriate actions.

EXAMPLE 1

A new type of detector may be introduced into the detector network that requires the ACU to carry out a specific sequence of actions in response to detected events. A fresh instruction code can be transmitted from the AMS to the ACU, and stored thereon, as a programme module.

The AMS can also ensure that the AMSys Configuration record is consistent with the ACU configuration by remote reprogramming.

Transmission of Messages from the AMS to the ACU

Other communications may be passed between the AMS and ACU. Where the AMS is adapted to transmit messages and data to the ACU:

Text messages can be transmitted to the ACU for display on the screen, which would be immediately visible to the first person entering the monitored site.

A temporary PIN code can be sent to the ACU to permit a visitor to a monitored site to arm or disarm the system a single time without revealing the normal user PIN code.

Messages can be used to allow remote triggering of a variety of devices in the monitored site. Examples include remotely unlocking a door, programming a video recorder, controlling central heating and so on.

Reconfiguring the System via the User AMS Interface (107, 108, 109)

This interface (107), accessible via the Internet, portable communications devices such as WAP phones, and voice telephony, allows the user to instruct the AMS (100). Suitable security must be built into the AMS to prevent unauthorised access, which could permit the alarm to be disabled. Measures include:

Use of encrypted passwords and memorable data.

Use of a device-generated time-dependent code sequence.

Incorporation of feedback to the last known user contact point confirming the instructions received through the User AMS Interface (107) (thus allowing the user to detect unauthorised access.)

Incorporation of a time delay in carrying out instructions that might compromise the effectiveness of the system (such as changes to Alert Actions, remote configuration commands and the like.)

Ability to Perform Actions Specified by the User in Response to an Alert

Users are able to use the User AMS interface (107) to record the actions they would like to take place when specific Alerts occur. These actions would form the basis of the pre-set routines stored on the AMS that enables the AMS to respond to events. A wide range of Alert Actions may include:

Initiation of an Automatic False-Alarm Reduction Check

Recording of the Alert in the Alert log.

Automatic placement of telephone calls to Alert Recipients (700) by means of Voice Synthesis software, informing the Alert recipient of the Alert.

Automatic generation of an e-mail to an Alert Recipient informing the Alert recipient of the Alert.

Automatic generation of a message to a pager or other mobile device informing the Alert recipient of the Alert.

Automatic recording of the Alert and subsequent Alert Actions in the Activity log (including failed attempts to carry out an Alert Action.)

Specification of times of the day, days of the week and holiday periods when the Alert Action should not be carried out, for example to not call elderly relative after 10 PM to inform them of mains power failure or other minor events.

Automatic notification of Alert to police, private security firm, fire brigade or other nominated party.

Automatic triggering of a call to pre-determined User number, such as a mobile phone number, to ask a user whether they would like attendance by private security firm.

Automatic initiation of video image capture or sound recording.

The Alert Recipient may be, but not essentially be, the user. The user may also nominate further Alert Recipients or nominate different recipients for Alerts relating to different events. Any number of Alert Actions can be associated with an Alert. If the AMS is unable to complete an Alert Action it should continue to attempt to complete the action for a finite period, or until the Alert is cancelled.

If an Alert is cancelled following a Cancellation Sequence the AMS can be configured to contact all Alert Recipients with a message that the Alert has been cancelled and no further action is required.

Visual Presentation of Activity Log

Users may view the Activity Log (106) via the Internet, or by dialling in to an Interactive Voice Response System, described hereinabove, that can read out the contents of the Activity Log using voice synthesis software.

The Activity Log (106) conveniently provides three functions:

1. It can be used to test the system. When the system is in 'Test' mode Alerts are generated as normal and logged in the Activity Log, but no other Alert Actions are carried out. Thus, a user can activate all the detectors in the system and verify that Alerts are generated.

2. It can be used to check the response to an Alert. This has two main benefits in use:
   a) The user can determine which Alert Actions were carried out and take steps to cancel any actions on the part of the recipients if they are not required, e.g. if there is a false alarm, and
   b) Verify that the AMS carried out the correct sequence of actions in response to an alert, e.g. if an Alert Recipient did not receive a message the Activity Log may reveal that call attempts were made but the phone line was engaged.
3. It can be used to provide a monitoring function. The monitoring may be required by a business that wants to verify that security staff do, in fact, make periodic patrols within an office. A monitoring system equipped with a movement detector could record the Alerts generated by the security staff for service verification purposes, but take no other action.)

Some embodiments of the system can be provided with further preferred features:

Visual Display of Remote Video Images or Remote Sound

In an ACU equipped with circuitry enabling a video image detector, video information may be sent directly to the AMS in response to an instruction from the AMS to so do.

These video transmissions might take advantage of video compression technology inserted between the video capture device and the ACU, and decompression software and hardware within the AMS.

The AMS is able to record these images on computer storage devices and, in response to an instruction from the user via the AMS user interface, relay the images on via the internet or other telephony link for viewing by the user or by third parties such as the police. The AMS is also able to archive these pictures for later evidential use.

The foregoing may also apply where a sound detector rather than a video image detector is included in the network of detectors.

Automatic False-Alarm Reduction Check

The user may choose to have the AMS perform an Automatic False-Alarm Reduction Check upon receiving an Alert and prior to undertaking any other Alert Actions.

The Automatic False-Alarm Reduction check involves the AMS calling the monitored site where the alarm is located, or the user via a mobile communications device, and requesting a PIN number, or some other code or unique identifier. The user may be asked to provide the code by means of a synthesised voice generated by the AMS, or through other means, such as text messages. If the user correctly enters the code then the Alert is considered to have been activated by mistake. If the correct response is not received then the AMS continues to carry out all the Alert Actions associated with the Alert.

The Automatic False-Alarm Reduction Check may be enabled or disabled by the user via the User AMS Interface.

Zonal Monitoring at the AMS

The AMS contains a description of the configuration of each alarm system it is monitoring, and it maintains a database of alerts received from the local ACU. It is therefore possible to offer a zonal monitoring system that detects successive alerts from the same ACU to detect multiple indications from different detectors within the same monitored site.

The AMS can be configured to generate its own zonal alerts, which can have a set of associated alert actions in much the same way as ACU generated alerts. This will allow AMS to offer a zonal detection system that will greatly reduce false alarms due to erroneous detection.

EXAMPLE 2

A house is fitted with three movement detectors and two contact switches. The owner does not want external sirens to be activated or police to be called unless two or more detectors are triggered, and has created a zonal alert within the AMS to this effect.

An intruder breaks in and activates a movement detector. The ACU uses web buffering to inform the AMS and requests a Cancellation Sequence, which the intruder is unable to supply. AMS registers the alert and carries out Alert Actions associated with the detector. The intruder moves around the monitored site and activates a contact switch, which generates a second alert. The ACU immediately activates local sirens and informs the AMS, which recognises that a second detector has been activated and generates a zonal alert. The associated Alert Actions for the zonal alert are carried out, which Alert Actions may include notification to police.

In this way the AMS is able to perform zonal monitoring for many ACUs. This reduces the chances of triggering responses to false alarms caused be erroneous detector activation.

Activation of Sound Feeds as an Alert Verification

The AMS can instruct the ACU to activate a microphone and transmit a continuous sound feed from the microphone through the ACU to the AMS. The AMS can monitor this sound feed for unexpected sounds that may indicate the presence of an intruder. This could be used to provide additional verification of an intruder to police.

AMS can also relay the sound in real time to a user (or other specified recipient) via the Internet, allowing the user to listen to sounds within the monitored site. The sound detection could be used to detect other audible events, such as an audible alarm or, where monitoring is provided at agricultural sites, sounds indicating that animals may require assistance.

Activation of the sound feed can be an Alert Action in response to an Alert.

Activation of Video Feeds as a Possible Response

The AMS can instruct the ACU to activate a camera and transmit a video feed from the camera through the ACU to the AMS. This video feed could be single frame, low speed or high speed video, could be real time or buffered and could be of various resolutions, depending on the equipment connected to the ACU and the bandwidth available to communicate between the ACU and the AMS. The AMS can perform a number of actions in response:

- The AMS can store images in secure long-term storage for possible later use as evidence of e.g. a security breach.
- By using image-scanning software the AMS can compare a reference image which was captured when the security system was armed with an image taken if the camera is triggered by movement. By detecting significant data variation, which may correspond to the presence of an intruder, this could be used to provide additional verification of an intruder.
- The AMS could receive infrared images to detect the presence of a heat source, which might be an intruder or a fire or a process failure.
- The AMS could relay the image to a user or other specified recipient via the Internet, allowing the user to view the interior of the monitored site, or to view-stored images. The images can be used to assess the need to respond to a detected event, such as flood, vandalism or security breach.

Activation of the video feed can be an Alert Action in response to an Alert.

EXAMPLE 3

A domestic dwelling has a doorbell that act as a detection device for in the monitoring system and can communicate with the ACU The dwelling also possesses a fixed frame digital camera that takes a picture of the door when the bell is pressed. When the doorbell is rung and the system is armed an alert is sent to AMS. The associated Alert Action is for AMS to instruct ACU to relay the latest picture taken by the camera, allowing the user to remotely verify the identity of the caller. If the user so wishes they could use the other facilities of the monitoring system to remotely disarm the system and unlock the door to permit access.

EXAMPLE 4

A police force requires visual verification of an intruder before it will respond to an alarm. A business premises is equipped with a movement detector, a light and a digital video camera. When movement is detected and the system is alarmed the AMS instructs the ACU to switch on the light and transmit images from the video camera. These are stored at the AMS. The AMS also informs the user of the movement alert. The user may then log on to the AMS via the Internet and view images from the monitored site. If an intruder can be identified then police can be informed of a verified alert.

In alternative examples the AMS could be instructed to automatically compare the image received with a reference image from the same camera and to infer the presence of an intruder if significant differences exist between the observed and reference images.

Ability of AMS to Send Instructions to ACU, Including Operation of Remote Devices Such as Automatic Door Locks AMS can transmit instructions to ACU that can be relayed to detectors if they are capable of carrying out actions. This can include instructing a camera to take a picture, operating an automatic lock, switching a piece of electrical equipment on or off or controlling other predetermined processes such as controlling of on-off timers in a heating system.

EXAMPLE 5

A pub cellar is prone to flooding. A monitoring system is installed primarily as an intruder detection system, but is also equipped with a water detector and a remote relay, which permits the ACU to switch on or off a normal 240V mains socket. When water is detected in the cellar an alert is generated. An associated Alert Action is that the AMS instructs the ACU to switch on the 240V mains socket. A water pump is connected to this socket and the cellar is pumped dry. A second alert action is that the switch is turned off thirty minutes after it is turned on. If the cellar is still flooded then subsequent water Alert will be generated and the pump activated for a further thirty minutes.

A specific embodiment of the system comprises the following elements:

A plurality of detectors

An ACU adapted to detect alarm signals generated in response to detected events by the detectors The AMS The ACU can comprise physically discrete units able to communicate with each other via a local radio link or a fixed, or wireline, link. Generally the discrete units will be a first unit adapted to transmit information relating to generated signals to the AMS and one or more second units adapted to receive generated signals and transmit them, or information relating to them, to the first unit. This allows the generated alarm signal outputs of a number of detection devices to be monitored by a 'single' ACU. Such an arrangement is particularly useful where some of the detection devices generate visible alarm signal outputs in response to detected events, each requiring an uninterrupted line of sight path between the generated signal output and the part of the ACU adapted to receive detection device generated alarm signals. It also allows further detection devices to be introduced into a network of detection devices after the ACU has been set up, merely by placing corresponding further second units in positions where they can receive any signal generated by the further detection devices.

Figure 5:
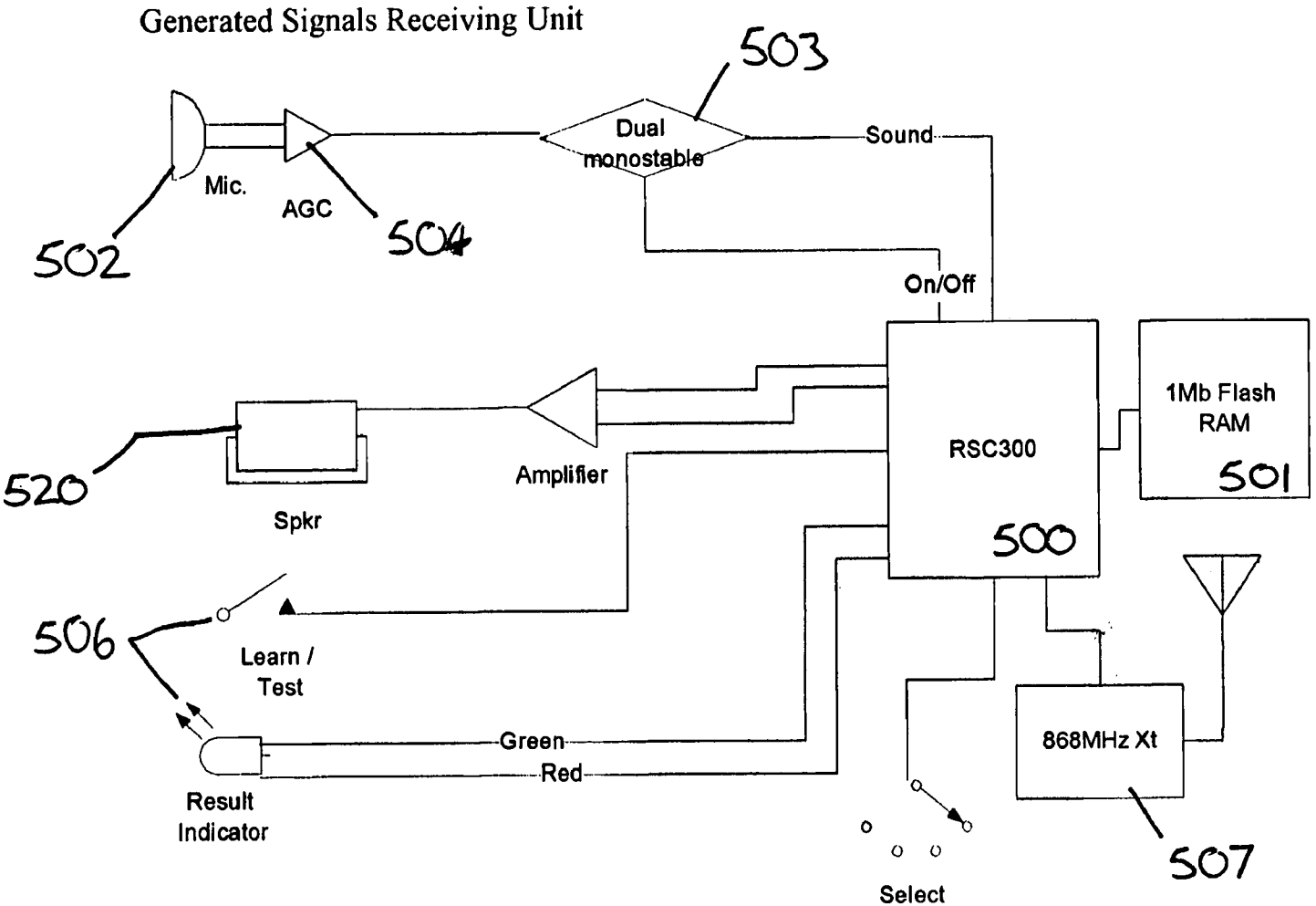
FIGS. 5 and 6 illustrate schematically elements of a local control unit usable in the system and constructed in accordance with the invention.

As illustrated in FIG. 5, the ACU (50) comprises an RSC300 chip (500), Flash (non-volatile) memory (501), a microphone (502) with a dual monostable (503) to control its operation and an automatic gain control (504), a speaker (520), user interface controls (such as buttons, lights and switches) (506), a low power radio transmitter (507), a power supply (which may be a battery, solar powered, mains supplied, or a combination thereof) and other components (resistors, capacitors, logic elements and the like).

Figure 6:
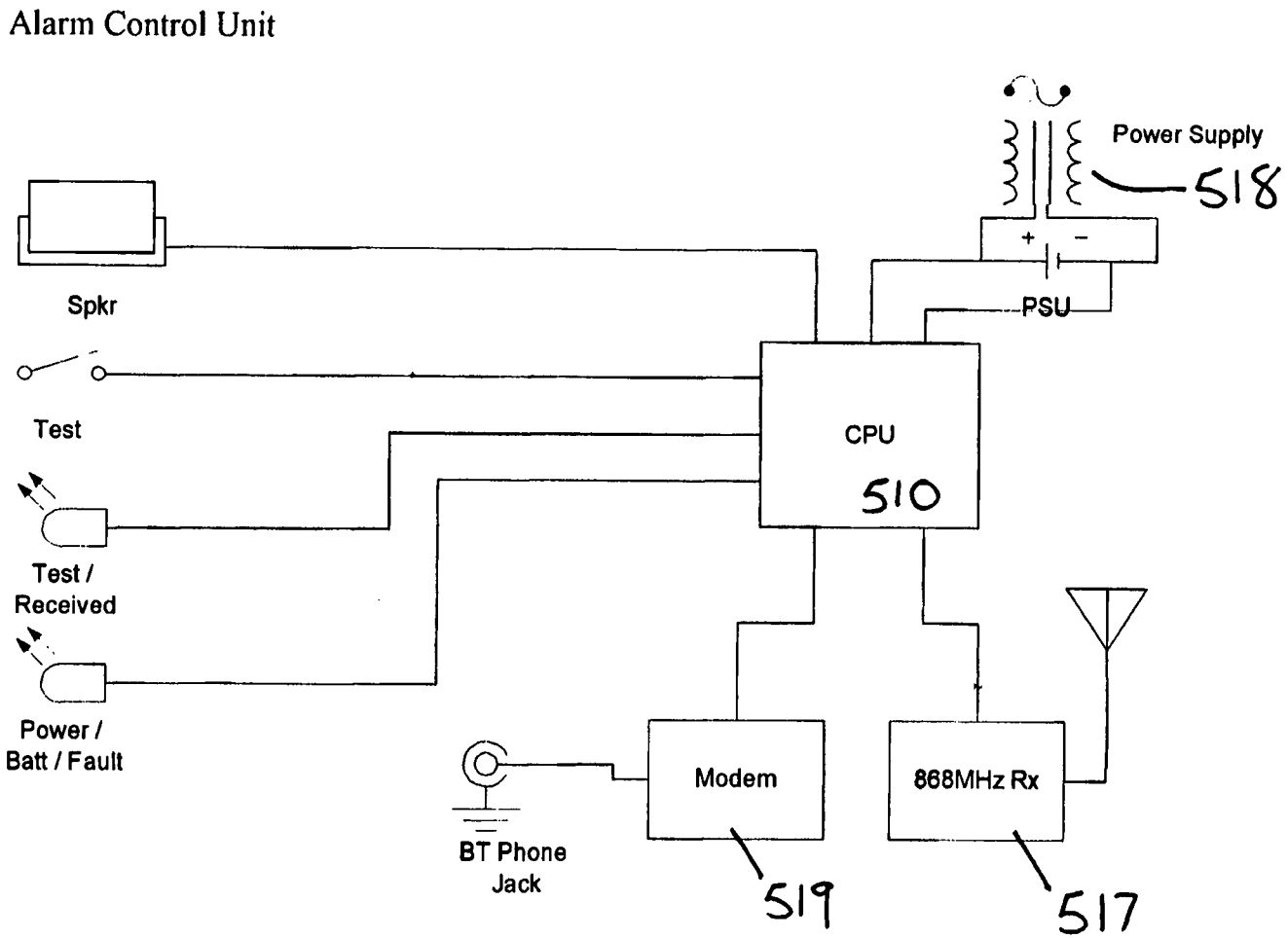

As illustrated in FIG. 6, the ACU (50) further comprises an 868 MHz low power radio receiver (517), microprocessor (510), some non-volatile memory, a power supply (518) with battery backup and a modem (519).

The software controlling the RSC300 (500), and the reference sounds and other data, are stored in the flash memory (501). In this way data and the controlling program are preserved in the event of power being lost (such as during the replacement of batteries. Other forms of non-volatile storage can be used in different embodiments, and backup batteries can be used in yet further embodiments allowing volatile memory to be used.

The dual monostable (503) is used as a means of switching the microphone (502) on for a short period and then off again in response to a signal from the processor. This allows the RSC processor to more reliably interpret sounds. The RSC300 (500) is designed to recognise words, and the silence at the start and end of the word are significant. The RSC300's pattern recognition algorithm cannot be interrupted so an external means is required to artificially break down the continuous sound of a siren in to a sound resembling a word, with silences before and after. This can be achieved in one embodiment by means of an electronic timing switch, which is activated by a signal from the RSC300 prior to pattern recognition. The effect of this switch is to disable the microphone (502) for a short period (e.g. 0.5 seconds), then enable it for a short period (e.g. 1.5 seconds), and then disable it for a short period again. Thus, the continuous siren tone is reduced to a 1.5 second sound burst. The timing switch instead of being a monostable may be an electronic timer, counter, or some other form of electronic counting circuit capable, upon receipt of a trigger, of disabling then enabling then disabling the microphone.

The RSC300 chip is able to record reference words and then subsequently recognise these words when spoken by the same person. In this invention the chip is used to record the sound of an alarm sounding. Then, when a loud sound is detected, the chip compares this sound with the recorded sound of the alarm sounding. If the two sounds match then the generated signal receiving unit sends a signal to the part of the ACU adapted to transmit information relating to the generated signals to the AMS, using the low power radio transmitter (507).

The signal receiving unit may be taught a number of reference sounds, in which case the message sent to that part of the ACU (50) adapted to transmit information relating to generated alarm signals to the AMS (100) can indicate the particular sound that was detected. In this way the ACU can recognise, and distinguish between, different alarms.

One problem with this approach is that occasionally the generated signal receiving unit may generate a 'false positive' signal when it mistakes a non-alarm sound for an alarm signal. Three methods may be used to reduce the likelihood of these false positive situations:

1. The automatic gain control has a user-selectable sensitivity allowing the system to respond only to sounds above a predetermined threshold (such as sirens and alarms) and to ignore normal background noises such as children's toys.
2. The software driving the detector incorporates an algorithm that initially requires a high degree of correlation between the observed sound. If a match is not found then subsequent samples and matching attempts are made until two (or more) matches against the same reference sound are obtained. The degree of correlation required can be allowed to fall as the number of samples increases. This method is useful if there is a possibility of one alarm sound being mistaken for another, or if a sudden and loud noise (such as something being dropped) generates a random pattern. In both cases the algorithm described will reduce the chance of a false positive result.
3. The generated signal receiving unit can have the ability to be taught other noises which it should ignore. So if, for example, a particular toy generates a sound which might be mistaken for an alarm then by recording the sound of the toy and checking for a pattern match against both the alarm sound and the toy sound the unit will match best against the toy, even though the match against the alarm would otherwise be adequate. Thus, false positives can be reduced to a low level.

Other means of reducing the impact of false-positive alerts can be built in to the AMS, by having the AMS place a check call to the monitored site. It is unlikely that a sound, that could be mistaken for an alarm, would occur within a monitored site when that monitored site are unoccupied.

EXAMPLE 6

The generated alarm signal receiving unit is trained to recognise three distinct alarm sounds: the 'Door Entry Alarm' which is heard when an authorised entry route is used to enter a monitored site with a an activated alarm, the 'Intruder Alarm', which sounds when an intruder is detected, and a 'Smoke Alarm', which can be completely independent of the intruder alarm system. The unit is also trained to recognise two 'Reject' noises—a vacuum cleaner and a child's toy.

In this embodiment the RSC300 is normally in 'sleep' mode, to reduce power consumption. When a sufficiently loud noise is detected an interrupt is generated which awakens the RSC300. The software controlling the RSC300 then takes repeated samples from the microphone and matches this sound against the recorded reference sounds. If the best match is not sufficiently good to be classified as a valid result then the recognition strictness is reduced and further readings are taken. If the best match is good enough to be registered as valid then the match is noted and further readings are taken. Once a maximum number of readings have been made, or two readings have yielded the same result, the software stops taking further readings and proceeds as follows:

If the same reference sound has been matched twice then the sound identification is confirmed and the sound identity is the matched reference sound. If one or more sounds have been matched only once then the identification is unconfirmed and the sound identity is the best matching reference sound.

If the best matching reference sound is a sound that is to be rejected ('Vacuum cleaner' or 'Child's Toy') then the Sound takes no further action. Otherwise the Sound sends a signal to the part of the ACU adapted to transmit information to the AMS via low power radio stating the sound identity and whether the sound identification is confirmed or unconfirmed.

The ACU then forwards this message to the monitoring station by means of wireline or wireless telephony.

Figures 4A, 4B:
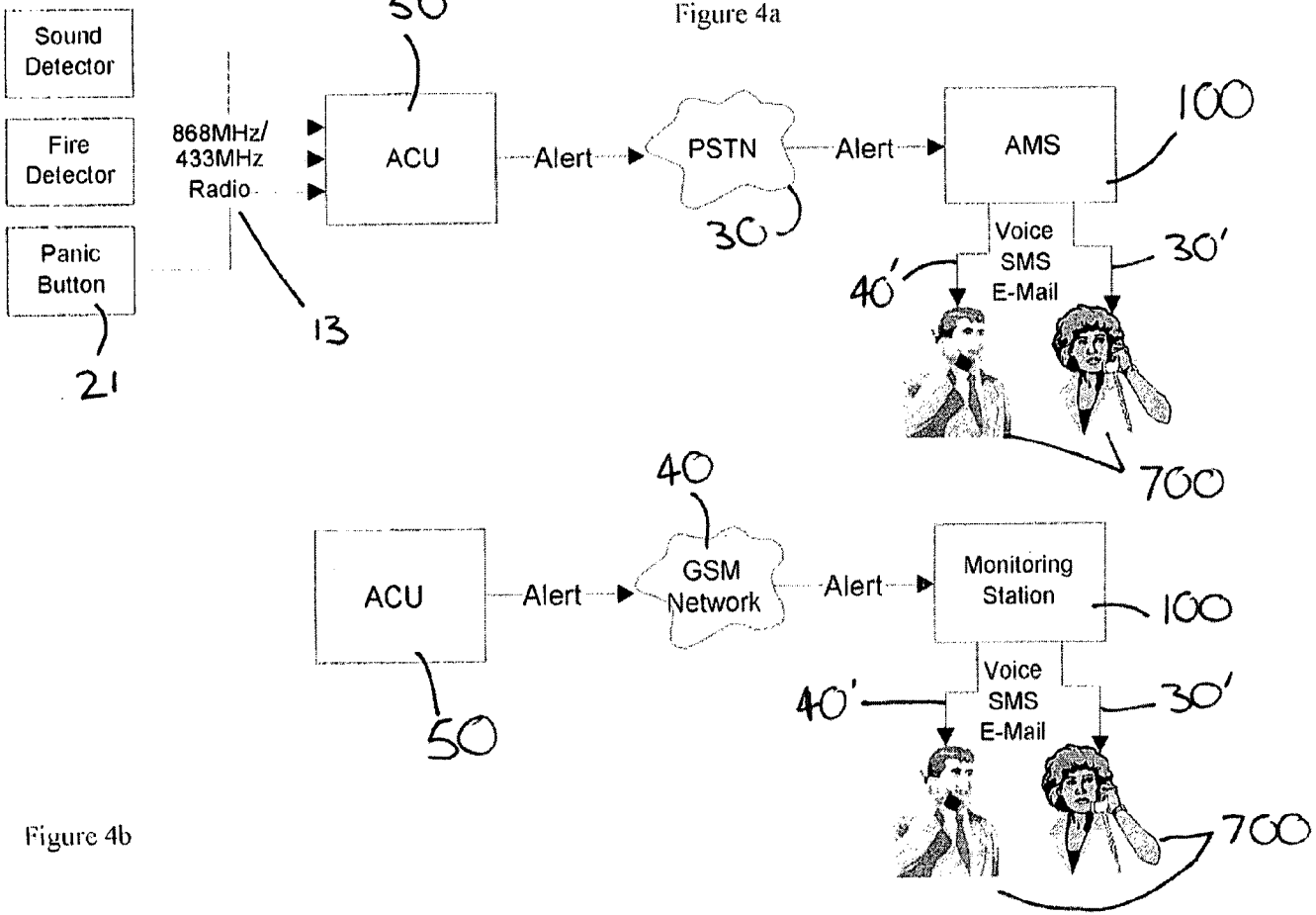
FIGS. 4*a* and 4*b* illustrate schematically the way in which the system can be used to send an alert.

This alert sending arrangement is shown in FIG. 4*a*.

The invention claimed is:

1. A monitoring and control system comprising:

a control unit for receiving signals from a variety of detection devices monitoring events pertaining to security, the control unit having means for transferring information related to the reception of such signals to a remote monitoring station and having control means for actively controlling one or more detection devices;

the monitoring station having programmable storage means storing automatic evaluation routines to initiate the automatic transfer of information to a chosen remote user terminal;

wherein the monitoring station is responsive to commands initiated by a remote user terminal, which is remote of the monitoring station and the site being monitored and which may be the chosen remote user terminal or an alternative remote user terminal, to establish a link between the remote user terminal and the control unit to cause the control means thereof to initiate a change in the operative state of at least one of the detection devices.

2. A system according to claim 1, wherein the monitoring station is responsive to commands initiated by the remote user terminal, which may be the chosen remote user terminal or the alternative remote user terminal, to effect changes to the automatic evaluation routines.

3. A system according to claim 1, wherein the monitoring station is responsive to a command request initiated by the remote user terminal to transfer additional information to the monitoring station and/or the remote user terminal.

4. A system according to claim 1 wherein the detection devices include fire or heat or CO sensors.

5. A system according to claim 1, wherein the at least some detection devices generate audio signals or light signals differentiable in terms of frequency, intensity and/or time.

6. A system according to claim 1, wherein the detection devices include or are supplemented by at least one video camera and video images are transferable to the monitoring station.

7. A system according to claim 1, wherein the detection devices include at least one microphone and audible signals are transferable to the monitoring station.

8. A system according to claim 3, wherein video images and/or audio signals represent the additional information.

9. A system according to claim 1, further comprising means for checking and evaluating the responses to events in relation to predetermined criteria to inhibit the transfer of information or modify automatic evaluation routines where detected events are deemed not significant.

10. A system according to claim 1, wherein the monitoring station is programmed to perform predetermined external control functions on the control unit.

11. A system according to claim 1, wherein the control unit is adapted to respond to the receipt of an initial signal indicating an event by transferring information immediately to the monitoring station and the monitoring station is adapted to wait for a short period of time after receipt to enable a cancellation command to be received to terminate the subsequent operation of the monitoring station.

12. A system according to claim 1, wherein the monitoring station independently serves to transfer messages and data to the control unit.

13. A control unit for use in the monitoring and control system of claim 1, said control unit comprising: interface means for receiving signals generated by detection devices in response to detectable events and means for transmitting information relating to received signals to the remote monitoring station.

14. A control unit according to claim 13 capable of receiving signals of the same general character from the variety of detection devices, wherein the control unit is equipped with or linked to means for differentiating or discriminating between such signals and the events which caused the signals.

15. A control unit according to claim 14, wherein the means for differentiating or discriminating between such signals and the events which caused the signals comprises a store of reference signals and means for receiving signals and comparing received signals to stored reference signals.

16. A control unit according to claim 15, wherein the store of reference signals includes alarm signals and non-alarm signals of the same general character.

17. A control unit according to claim 14 wherein the means for differentiating or discriminating between such signals and the events which caused the signals differentiates or discriminates between audible signals.

18. A control unit according to claim 14 wherein the means for differentiating or discriminating between such signals and the events which caused the signals differentiates or discriminates between visible signals.

19. A control unit according to claim 13, wherein the means for receiving signals and the means for transmitting information relating to received signals are located in different parts of a monitored site and are operably linked by wireless or wireline transmission.

20. An automatic monitoring station for receiving first information related to events detectable by detection devices, for use in a monitoring and control system according to claim 1, the monitoring station comprising means adapted to receive such first information and programmable storage means storing:

i) routines for evaluating received first information, ii) a record of actions to be taken in response to a variety of types of evaluated first information, iii) routines for matching evaluated first information to a particular stored action or set of actions, and iv) routines for initiating the matched action or set of actions; wherein some actions include transferring second information relating to detected events to the chosen remote user terminal.

21. A monitoring and control system according to claim 1 further comprising an alarm control unit, said alarm control unit comprising:

i) a detector for receiving signals from the one or more pre-existing alarm systems;

ii) a communications module;

iii) means for recording reference samples of different signals produced by the one or more pre-existing alarm systems;

iv) means for distinguishing the signals from one another and from background interference, by comparing the detected signals or interference with the recorded reference signals; and v) means for transmitting an output via the communications module.

22. A method of monitoring a site equipped with one or more detection devices for monitoring events pertaining to security and generating signals in response to detectable events, the method comprising:

utilizing a local control unit for receiving signals related to events pertaining to security, the local control unit having means for transferring information related to the reception of such signals to a remote monitoring station and having control means for actively controlling the one or more detection devices;

utilizing a monitoring station, remote from the local control unit, to initiate the automatic transfer of information to a chosen remote terminal in accordance with automatic evaluation routines programmed onto the monitoring station; and enabling the monitoring station to respond to commands initiated from a remote user terminal, which is remote of the monitoring station and the site being monitored and which may be the chosen remote user terminal or an alternative remote user terminal, to establish a link between the remote user terminal and the control unit to cause the control means thereof to initiate a change in the operative state of at least one of the detection devices.

23. A method according to claim 22 further comprising enabling the monitoring station to respond to commands initiated from the remote user terminal, which may be the chosen remote user terminal or the alternative remote user terminal, to effect changes to the automatic evaluation routines.

24. A method according to claim 22 further comprising enabling the monitoring station to respond to a command request to transfer additional information to the monitoring station and/or the remote user terminal.

25. A method according to claim 22, wherein the local control unit or the monitoring station are adapted to determine the nature of the detected event prior to information being transferred to the remote terminal.

26. An alarm control unit (ACU) for use in combination with one or more pre-existing alarm systems, wherein the ACU comprises:

i) a detector for receiving signals from the one or more pre-existing alarm systems;

ii) a communications module;

iii) means for recording reference samples of different signals produced by the one or more pre-existing alarm systems;

iv) means for distinguishing the signals from one another and from background interference, by comparing the detected signals or interference with the recorded reference signals; and v) means for transmitting an output via the communications module.

27. An ACU according to claim 26 wherein the signals are audible sound.

28. An ACU according to claim 27 wherein the detector is a microphone.

29. An ACU according to claim 26, wherein the means for distinguishing the signals from one another and background interference is a speech-recognition chip.

30. An ACU according to claim 28 wherein the detector is a microphone and the microphone is intermittently activated and then deactivated, so that it detects sound in bursts with periods of silence before and after each burst; whereby the sound is adapted for interpretation by the speech recognition chip.

31. An ACU according to claim 30 wherein the period of activation is 1.5 seconds and the period of deactivation is 0.5 seconds.

32. An ACU according to claim 30, wherein the speech recognition chip is an RSC 300 speech recognition chip.

33. An ACU according to claim 26 wherein, once the ACU has matched a signal to a reference sample, it transmits information relating to the signal to a monitoring station.

34. An ACU according to claim 33 wherein, the transmitted information indicates the particular signal that was detected.

35. An ACU according to claim 26, wherein reference samples of background interference are recorded and compared with the detected signals or background interference.

* * * * *